US006499141B1

(12) United States Patent
Egnew

(10) Patent No.: US 6,499,141 B1
(45) Date of Patent: Dec. 31, 2002

(54) MULTIDIMENSIONAL CAMOUFLAGE OUTER WEAR GARMENT SYSTEM

(75) Inventor: James C. Egnew, Stearns, KY (US)

(73) Assignee: Shelter-Pro, LLC, Stearns, KY (US)

( * ) Notice: Subject to any disclaimer, the term of this patent is extended or adjusted under 35 U.S.C. 154(b) by 0 days.

(21) Appl. No.: 09/982,184

(22) Filed: Oct. 17, 2001

Related U.S. Application Data

(60) Provisional application No. 60/313,616, filed on Aug. 20, 2001.

(51) Int. Cl.[7] ..... A41D 13/00

(52) U.S. Cl. ..... 2/69; 2/108; 2/227; 2/900; 2/79; 428/919

(58) Field of Search ..... 2/900, 108, 93, 2/94, 85, 96, 84, 202, 203, 206, 227, 79, 69, 80, 82, 69.5; 428/919, 15, 17

(56) References Cited

U.S. PATENT DOCUMENTS

| | | | | | |
|---|---|---|---|---|---|
| 875,595 | A | | 12/1907 | Overbury | |
| 881,024 | A | | 3/1908 | Overbury | |
| 1,611,420 | A | * | 12/1926 | Cuddy | 2/79 |
| 2,039,478 | A | * | 5/1936 | Ensten | 2/206 |
| 2,351,142 | A | | 6/1944 | Mitchell | |
| 2,362,786 | A | | 11/1944 | Williams | |
| 2,370,734 | A | | 6/1945 | Jost | |
| 2,585,840 | A | * | 2/1952 | Reynolds | 2/79 |
| 2,839,757 | A | * | 6/1958 | Gianola | 2/206 |
| 2,911,652 | A | | 11/1959 | Ekman | |
| 3,069,796 | A | | 12/1962 | Rutler | |
| 3,650,881 | A | | 3/1972 | Giannone, Sr. | 161/111 |
| 3,733,606 | A | | 5/1973 | Johansson | 131/652 |
| 3,779,448 | A | | 12/1973 | Wootten | 155/781 |
| 4,106,124 | A | | 8/1978 | Green | 775/925 |
| 4,323,605 | A | | 4/1982 | Rush | 113/468 |
| 4,517,230 | A | * | 5/1985 | Crawford | 428/17 |
| 4,931,320 | A | | 6/1990 | Leonard | 377/57 |
| 5,013,375 | A | | 5/1991 | Leonard | 377/83 |
| 5,251,336 | A | * | 10/1993 | Nevins | 2/84 |
| 5,261,978 | A | | 11/1993 | Reynolds | 898/332 |
| 5,281,451 | A | | 1/1994 | Reynolds | 898/424 |
| 5,347,659 | A | * | 9/1994 | Tibljas | 2/243.1 |
| 5,476,561 | A | | 12/1995 | Bylund et al. | 123/456 |
| 5,486,385 | A | | 1/1996 | Bylund et al. | 428/17 |
| 5,695,835 | A | * | 12/1997 | Weber et al. | 428/17 |
| 5,727,253 | A | * | 3/1998 | Wilkinson | 2/69 |
| 5,920,903 | A | * | 7/1999 | Koehntop et al. | 2/69 |
| 6,047,404 | A | * | 4/2000 | Blanksi | 2/108 |

* cited by examiner

*Primary Examiner*—Gloria M. Hale
(74) *Attorney, Agent, or Firm*—J. M. Robertson Intellectual Prop, LLC

(57) ABSTRACT

A multidimensional camouflage outer wear garment system including garments made of various combinations of two-dimensional and three-dimensional camouflage material. The two-dimensional and three-dimensional camouflage materials are positioned within garments so as to distort the smooth line silhouette of the wearer, thereby enhancing the total effectiveness of the camouflage. Zones of three-dimensional material are disposed across limited selected regions of the garments to maintain continuity of silhouette distortion while two-dimensional material is disposed over predefined extended regions adjacent the zones of three-dimensional material.

33 Claims, 6 Drawing Sheets

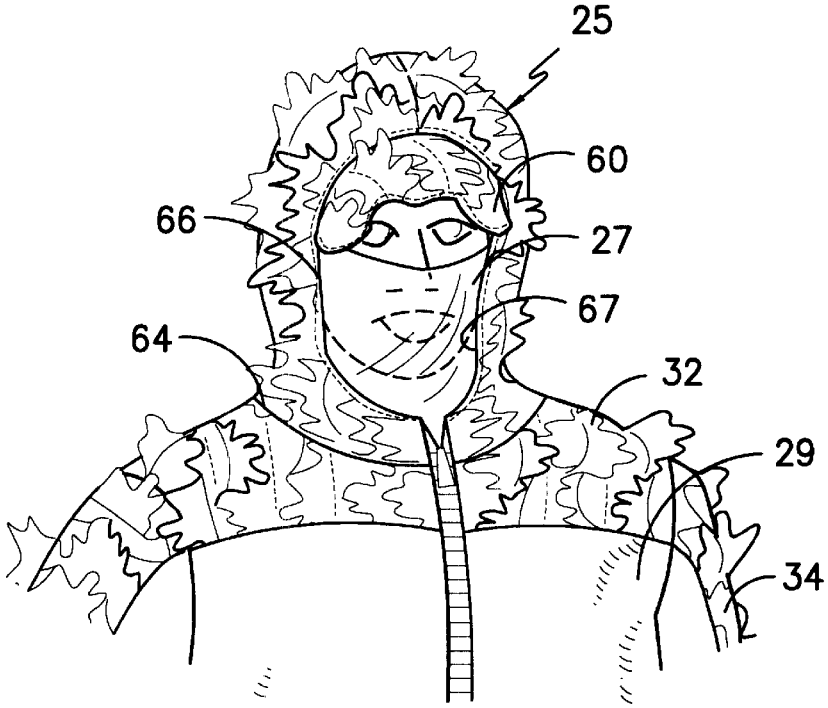
FIG. –5A–
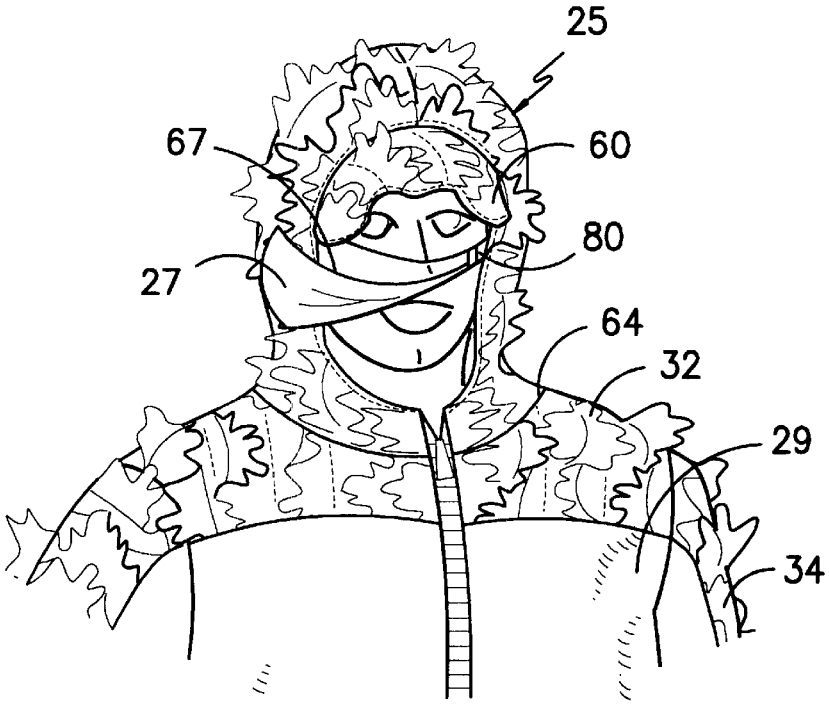
FIG. –5B–

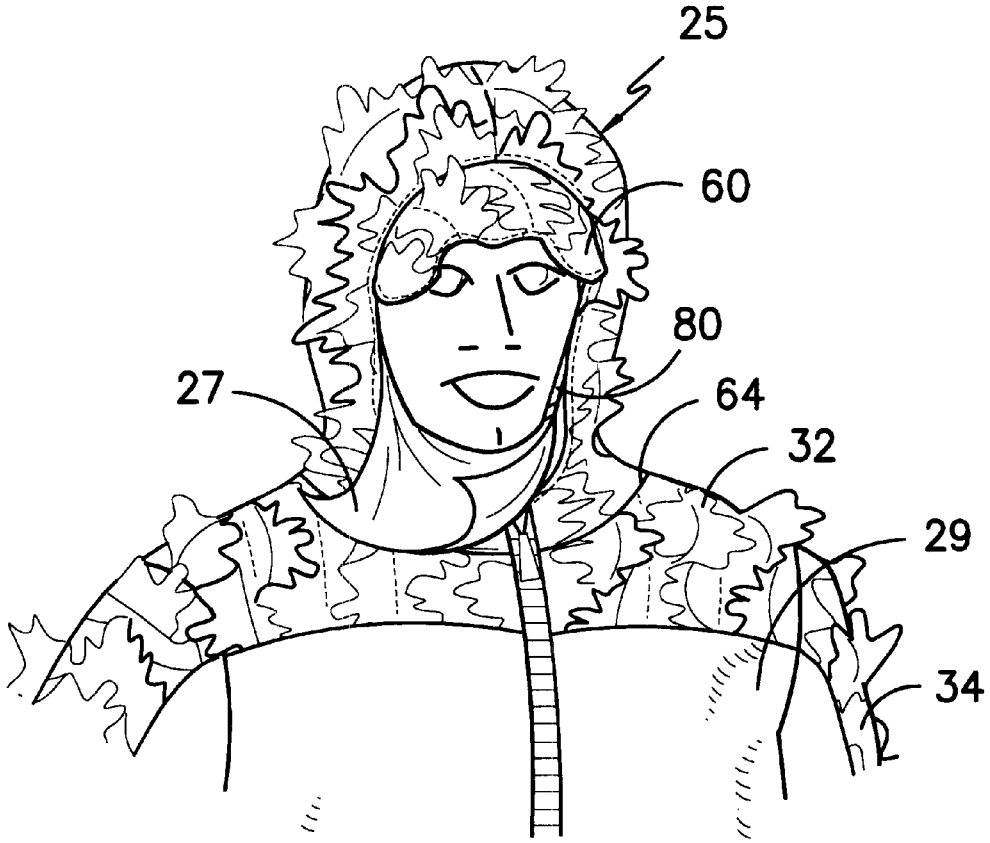
FIG. –5C–

MULTIDIMENSIONAL CAMOUFLAGE OUTER WEAR GARMENT SYSTEM

CROSS-REFERENCE TO RELATED APPLICATION

This application claims priority from United States Provisional Application No. 60/313,616 having a filing date of Aug. 20, 2001.

TECHNICAL FIELD

The present invention is directed to camouflaged clothing generally to be used by sportspersons, hunters, photographers, and others observing wildlife in their natural environment. More precisely, the invention addresses the use of two and three-dimensional materials in the manufacture of camouflage garments. Even more specifically, the invention addresses selective utilization of three-dimensional material in combination with two-dimensional material.

BACKGROUND OF THE INVENTION

The use of manufactured camouflage material is an extension of the use of natural materials to cause a structure or individual to blend into its natural background and escape visual detection. The development of camouflage materials has led to the manufacture of clothing with the same purpose as the use of natural materials, causing the wearer to blend into the natural background with emphasis on vegetation and terrain.

For purposes of this invention, camouflage material is divided into two distinct categories: two-dimensional material which is generally flat in profile having a length dimension and a width dimension, but a negligible thickness dimension, and three-dimensional material having length, width, and a significant thickness dimension. Two-dimensional materials may be made from woven, knit or other fabric constructions as will be well known to those of skill in the art as well as from non-fabric constructions. Although the two-dimensional material may be a solid camouflage color, most frequently the material is dyed or colored in a multi-colored pattern to simulate the pattern and coloration of the terrain and vegetation in which the camouflaged item is to be used.

In addition to the benefits of coloration and pattern provided by two-dimensional material, three-dimensional materials provide the additional feature of disrupting the outline or silhouette of an object when viewed from a reasonable distance. Such material not only looks like the native vegetation, but the three-dimensional aspect of the material allows it to move like native vegetation and to disrupt the normal silhouette of the wearer. It is known to create a three-dimensional fabric by utilizing a two layered structure and cutting the exposed outer layer in flaps, loops and similar shapes that simulate the shapes and sizes of natural vegetation, such as leaves, twigs, branches, and open spaces. As will be appreciated, cut pieces create the third, thickness dimension of the three-dimensional camouflage material.

U.S. Pat. Nos. 3,069,796, 4,323,605, and 4,375,488 (all incorporated by reference) disclose camouflaged material manufactured from variously colored, flexible, patterned sheets of fabric with patterned cuts employed to produce flaps and holes simulating the appearance of natural vegetation at a distance. U.S. Pat. No. 4,931,320 (incorporated by reference) discloses three-dimensional, camouflage fabric manufactured from a net base to which is affixed along spaced lines an overlaying sheet of two-dimensional camouflaged material. The sheet of camouflaged material is cut along opposite sides of the spaced lines in shapes and patterns to simulate natural vegetation, terrain, and shadows.

In recent years, the superior concealment afforded three-dimensional materials has increased the popularity of sports clothing manufactured from three-dimensional camouflage material. While three-dimensional materials provide excellent camouflage, the manufacture of such garments may be relatively complex. Moreover, the outwardly projecting surface elements may at times disrupt the desired activity. As noted in U.S. Pat. No. 5,695,835 (incorporated by reference), bow hunters must contend with the potential that the bow string or other moving parts of a bow might become entangled with exposed elements, loops or tongues, of the three-dimensional material. In addition, the exposed elements of the three-dimensional, camouflage fabric is subject to snagging on brush, other vegetation, hunting stands, and blinds resulting in damage to the fabric and disturbance of potential game or other animals of interest to hunters, photographers, or others.

BRIEF DESCRIPTION OF THE DRAWINGS

The present invention will now be described by way of example only, with reference to the accompanying drawings which constitute a part of the specification herein and in which:

FIG. 5A is a detailed view of a camouflage hood including a face mask closed to conceal the wearer;

FIG. 5B is a view similar to FIG. 5A wherein the face mask is open for convenience and comfort of the wearer; and FIG. 5C is a view similiar to FIG. 5A, wherein the face mask is pulled down beneath the chin of the wearer.

While the invention has been illustrated and will hereinafter be described in connection with certain potentially preferred embodiments and practices, it is to be understood that in no event is the invention to be limited to such illustrated and described embodiments and practices. On the contrary, it is intended that the invention shall extend to all alternatives and modifications as may embrace the principles of this invention within the true spirit and scope thereof.

DESCRIPTION OF THE PREFERRED EMBODIMENTS

Reference will now be made to the several figures wherein the same reference numbers are used throughout to describe the same feature, material, or relationship. As will be appreciated, three-dimensional fabric is potentially useful in camouflage apparel for disrupting the natural profile of the wearer. Moreover, characteristics of the three-dimensional camouflage fabric may also influence practical aspects of manufacturing garments, such as how various pieces are cut in a pattern and how they are stitched to produce the garment.

Figure 1:
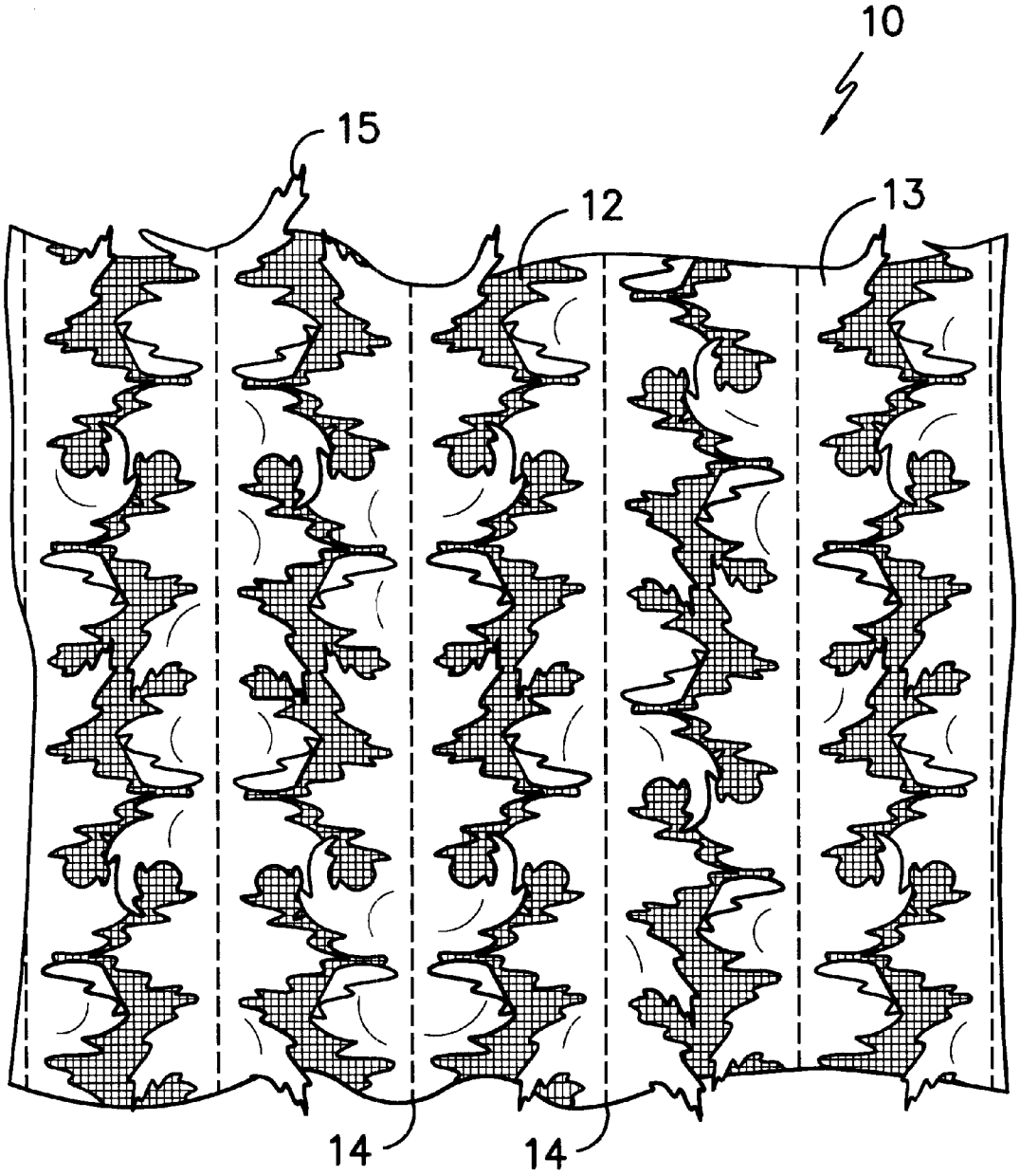
FIG. 1 illustrates one embodiment of a three-dimensional, camouflage fabric.

FIG. 1 illustrates the structure of one exemplary three-dimensional, camouflage material such as may be utilized in construction of the garments according to the present invention. As shown, the three-dimensional fabric 10 includes an open net substrate 12 on which is attached an overlay sheet material 13 with a camouflage design. In the illustrated structure, the sheet material 13 is attached to the net substrate 12 along the plurality of parallel stitch lines 14. However, other attachment patterns and techniques including by way of example only, "zig-zag" or serpentine attachment patterns as well as thermal and/or thermal fixation of the overlay sheet material 13 to the substrate 12 may also be utilized. The attached sheet material 13 is cut to form generally irregular lobes of material 15 the shapes of which simulate patterns of vegetation and background appropriate for the camouflage design of the sheet material 13. If desired, the fabric may be heated and lobes folded to enhance the openness of the fabric and to emphasize the third dimension aspect of the fabric 10. The sheet material 13 may be of any appropriate structure as may be known to those of skill in the art although relatively light-weight woven or knit textiles such as pongee cloth or a light weight knitted mesh of polyester or nylon may be preferred.

As indicated, the camouflage sheet material 13 is normally sewn to the underlying net substrate 12 as a coordinated structure prior to formation of the lobes 15. By way of example only, such sewing may be carried out using a MALIMO™ stitch bonding machine, or any similar machine as will be well known to those of skill in the art. However, it is also contemplated that the lobes 15 may be affixed across the net substrate 12 as preformed elements by adhesives, thermal fixation, sewing etc. in either a coordinated or random arrangement to yield the three-dimensional fabric 10. Preferably, the two-layer fabric 10 has a relatively light weight in the range of about 3 to about 7 ounces per square yard and most preferably about 4 to about 6 ounces per square yard. Of this weight, the net substrate preferably makes up about 2 to about 3 ounces per square yard while the sheet material 13 makes up the remaining portion having a weight of about 2 to about 3 ounces per square yard. By way of example only and not limitation, a suitable three-dimensional fabric 10 is a 100 percent polyester 3-D fabric believed to be marketed under the trade designation INTRIGUE by Milliken & Company having a place of business in Spartanburg, South Carolina, USA.

Figure 2:
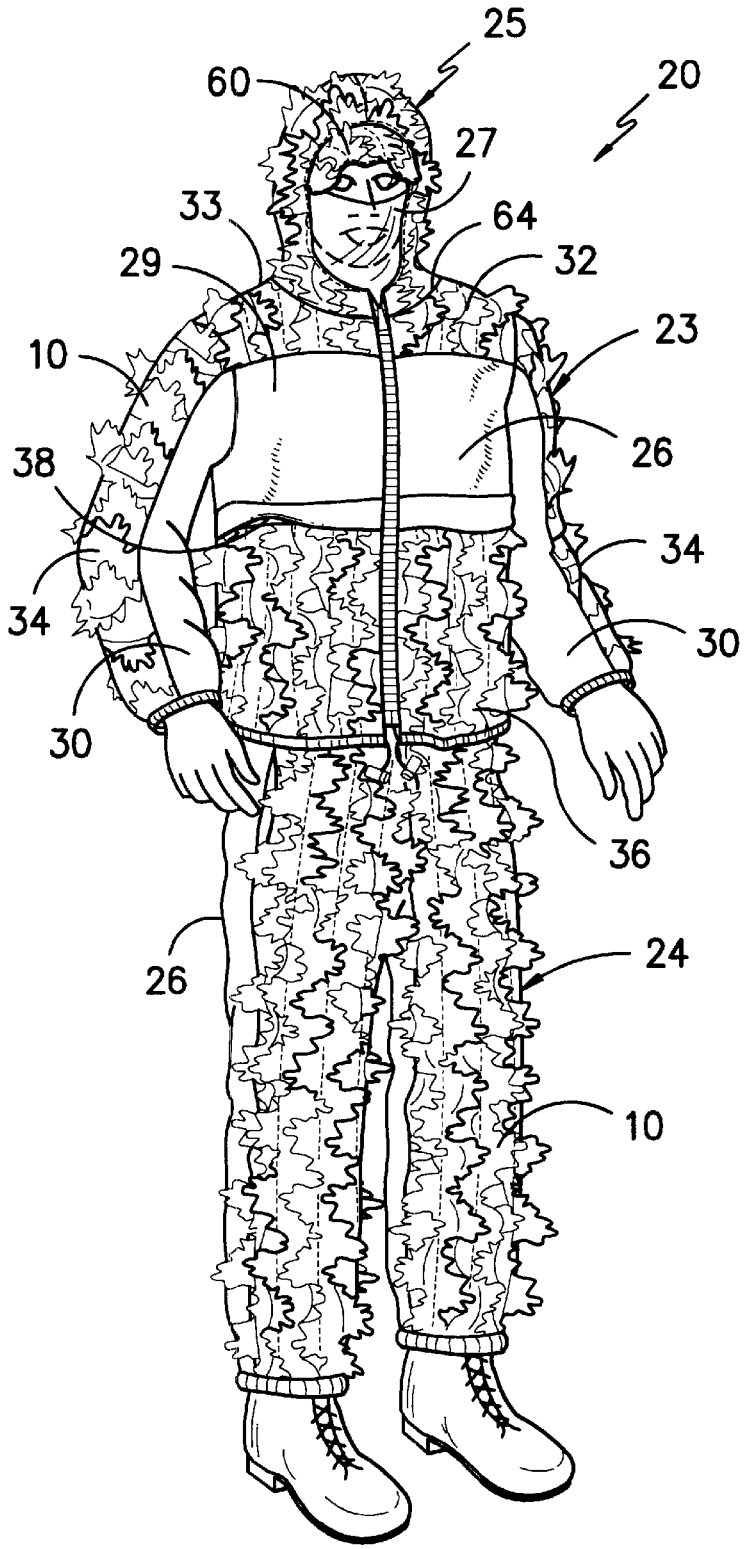
FIG. 2 is a front perspective view of a complete set of multidimensional, camouflage clothing.

As illustrated in FIG. 2, it is contemplated that the three-dimensional fabric 10 may be utilized selectively with substantially two-dimensional fabric within garments forming in combination a multidimensional suit 20 for use by a wearer. The multidimensional suit is preferably suitable to be worn in covering relation over a user's standard clothing. As discussed further hereinafter, the selective utilization of the heavier three-dimensional fabric 10 in combination with lighter weight two-dimensional fabric within the suit 20 provides a silhouette interrupting camouflaging effect while at the same time substantially reducing overall weight.

In the illustrated embodiment, the suit 20 includes a jacket 23, trousers 24, and a hood 25. Individual elements of the suit 20 are preferably manufactured from a combination of two-dimensional sheet material 26 such as woven or knitted fabric with camouflage coloration or printing thereon and three-dimensional material such as the three-dimensional fabric 10 as previously described in relation to FIG. 1 disposed at selected locations to form two-dimensional camouflage surface zones and three-dimensional camouflage surface zones respectively. The two-dimensional sheet material 26 is preferably a relatively light weight woven or knitted fabric. A woven pongee cloth or light weight knitted mesh of nylon or polyester may be preferred. According to one potentially preferred practice, the two-dimensional sheet material 26 forming the two dimensional camouflage surface zones of the jacket 23 and pants 24 may be the same material as the camouflage sheet material 13 forming the lobes 15 across the three-dimensional fabric 10. That is, the two-dimensional sheet material 26 at the two-dimensional camouflage surface zones of the jacket 23 and the pants 24 may have a construction and surface pattern corresponding substantially to the construction and surface pattern of the camouflage sheet material 13 at the surface of the three-dimensional camouflage surface zones of the jacket 23 and the pants 24 but substantially absent the underlying net substrate 12 and outwardly extending lobes 15. Of course different fabric constructions and/or surface patterns may also be used at the two-dimensional camouflage surface zones and the three-dimensional camouflage surface zones if desired.

Figure 3A:
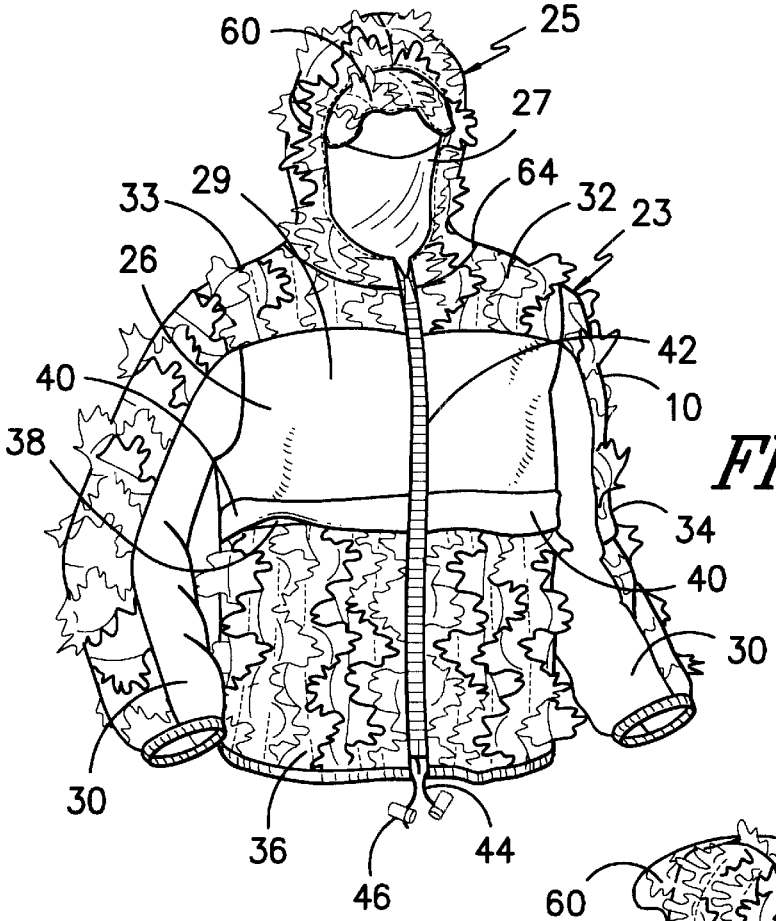
FIGS. 3A and 3B are respectively a front and a rear view of a multidimensional camouflage jacket and hood combination.
Figure 3B:
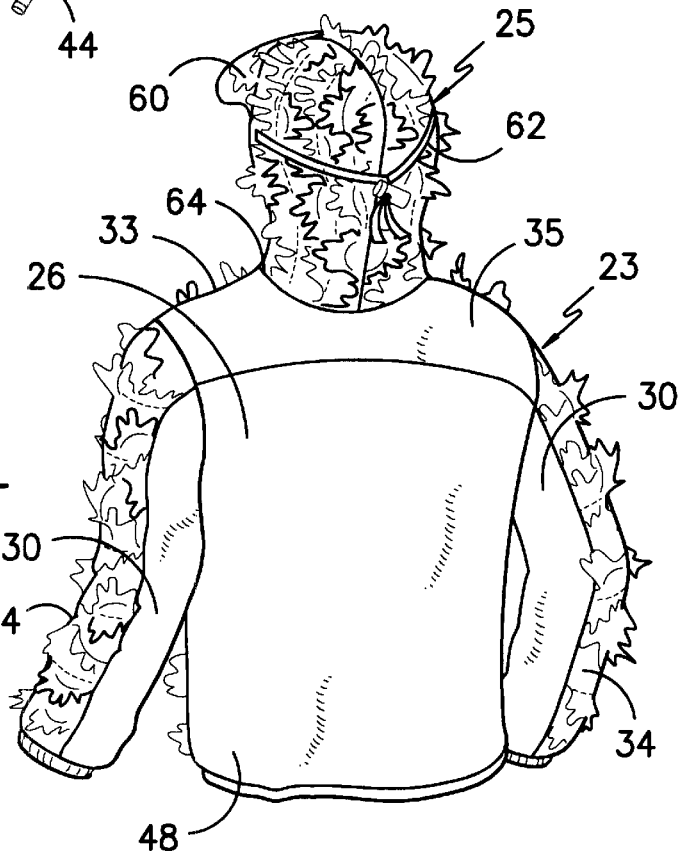

As best seen in FIGS. 3A and 3B the hood 25 excluding a displaceable face covering panel 27 is preferably manufactured substantially from the three-dimensional fabric 10. The face covering panel 27 is preferably manufactured from very light weight two-dimensional material of substantial permeability so as to provide the desired coverage while nonetheless promoting substantial ventilation. By way of example only, it is contemplated that the face covering panel 27 may be formed from a substantially two-dimensional mesh netting such as mosquito netting or the like. However, it is also contemplated that the face covering panel may be formed of other materials including by way of example only, the two-dimensional sheet material 26 used in the two-dimensional camouflage surface zones of the jacket 23 and/or the trousers 24.

As illustrated in FIG. 2, the three-dimensional camouflage fabric 10 is positioned in the garment to disrupt or distort the natural silhouette of the wearer, thereby enhancing the effectiveness of the camouflage coloration and pattern. As shown in the exemplary embodiment illustrated in FIGS. 2, 3A, 3B, 5A, 5B and 5C, the upper chest panel 29 and inner arm panels 30 of the jacket 23 are preferably formed substantially from two-dimensional sheet material 26. As will be appreciated, these areas do not constitute highly visible profile or silhouette areas when the wearer is standing still, seated, or in a kneeling position as would commonly be the case for hunters or photographers. Thus, it has been found that little additional benefit may be realized in using three-dimensional material in the chest panel 29 and inner arm panels 30.

In the illustrated embodiment, distortion of the user's body silhouette is provided by a forward shoulder yoke panel 32 and outer arm panels 34 of three-dimensional fabric 10. As shown, the forward shoulder yoke panel 32 extends across the upper shoulder portion of the user to a shoulder seam line 33. In the illustrated embodiment, the shoulder seam line 33 connects the forward shoulder yoke panel 32 to a complementary rear shoulder yoke panel 35. In the illustrated embodiment, the rear shoulder yoke panel 35 is formed from two-dimensional camouflage material although three-dimensional material may likewise be utilized in this region if desired. In the event that the rear shoulder yoke panel 35 is formed from two-dimensional material, the shoulder seam line is preferably positioned such that the forward shoulder yoke panel 32 extends to at least approximately the crest of the wearer's shoulders during use thereby providing distortion along the shoulder profile. As shown, the outer arm panels 34 serve to cover the visible outer surface of the arm thereby extending the pattern of profile distortion. If desired, the jacket 23 may further include a lower abdominal panel 36 formed from the three-dimensional fabric 10 thereby adding continuity to the three dimensional effect. Of course, the lower abdominal panel 36 may also be formed of two dimensional material if desired.

As indicated, the jacket 23 is preferably of a construction which is easily worn over a user's regular clothing. However, during use it is generally undesirable to remove the jacket 23 to obtain access to the pockets of the interior clothing. The jacket 23 preferably includes a pair of slit openings 38 disposed between the abdominal panel 36 and the upper chest panel 29 on either side of the jacket 23 to permit access to an inner shirt or jacket. The openings 38 are preferably covered by cooperating flaps 40 arranged across the lower portion of the upper chest panel. While the slit openings 38 are illustrated as being substantially horizontal in orientation, it is likewise contemplated that other orientations such as vertical or slanted orientations may also be utilized if desired. As illustrated, the jacket 23 also preferably includes a zipper 42 or other suitable closure device such as snaps, buttons, and cooperating hook and loop fabric strips as will be well known to those of skill in the art. A drawstring 44 with a mechanical keeper device 46 permits additional adjustment.

FIG. 3B provides a rear view of the jacket 23. As shown, the back portion extending away from the rear shoulder yoke panel 35 may be formed from a single back panel 48 of the two-dimensional sheet material 26 to form a two-dimensional camouflage surface extending across the back below the rear shoulder yoke panel 35. Of course, multiple panels of material may also be utilized if desired.

Referring simultaneously to FIGS. 3A, 3B, 5A, 5B and 5C, in the illustrated and potentially preferred embodiment, the hood except for the face covering panel 27, is made from the three-dimensional fabric 10. According to the illustrated and potentially preferred embodiment, the front of the hood 25 is open, with a visor 60 for eye protection and comfort of the wearer. The visor 60 is preferably constructed of a panel of the same three-dimensional fabric 10 as used in other portions of the hood 25. In such a construction the net substrate 12 provides sufficient stability to support the visor 60. However, it is also contemplated that the visor 60 may incorporate additional stiffening structures such as a layer of nonwoven felt or the like as will be well known in the art if further stiffening is desired. As shown, the hood 25 is preferably adjustable by means of a drawstring 62 (FIG. 3B) extending rearwardly from positions adjacent the visor 60.

The hood may be attached to the yoke panels 32, 35 of the jacket 23 along a neck seam 64 such that the hood 25 and the jacket 23 are integral with one another in substantially permanently fixed relation. It is also contemplated that the hood 25 and jacket 23 may be joined by disengageable attachment elements including by way of example only, zippers, snaps, buttons and hook and loop fabric fasteners. It is also contemplated that the hood 25 may not be physically attached to the jacket 23 but rather may be a separate structure. In such an arrangement the neck portion of the hood 25 may drape partially over the user's shoulders or may be tucked under the neck opening in the yoke panel 32 at the location of the neck seam 64.

The face mask panel 27 illustrated in FIGS. 5A, 5B and 5C is preferably held in place along an extended portion of a first lateral edge 66 by a fixed attachment such as a sewn seam between the face mask panel 27 and one side of the face opening. As shown, the face mask panel 27 preferably is also operatively connected to the opposing side of the face opening at an upper portion of an opposing lateral edge 67 so as to establish a hinge forming connection between the face mask panel 27 and the opposing side of the face opening. The hinge forming connection may be established by either direct or indirect attachment of the face mask panel 27 adjacent the edge of the hood opening.

By way of example only, it is contemplated that the hinge forming connection may be established by a relatively short narrow highly extensible elastomeric fabric strip 80 extending between the face mask panel 27 and an interior location adjacent the edge of the face opening so as to normally pull the opposing lateral edge 67 of the face mask panel 27 under the edge of the face opening to facilitate uninterrupted concealment across the user's face while nonetheless permitting the user to raise the lower portion of the face mask panel away from his or her mouth and away from the edge of the face opening as shown in FIG. 5B. In addition, the use of the elastomeric fabric strip 80 to effect connection between the face mask panel 27 and the edge of the hood opening permits the user to pull the hood 25 back over his or her head during which the hood opening may have to expand. Thus, the face mask panel 27 does not unduly constrict the hood opening. As illustrated in FIG. 5C, the use of the elastomeric fabric strip also permits the user to pull the face mask panel down below his or her chin if face coverage is not desired without the necessity of removing the hood 25. Thus, the wearer may either raise the face mask panel in a flap-like manner or may pull the face mask panel 27 down below the chin to eat or drink without completely removing the mask or hood.

Figure 4:
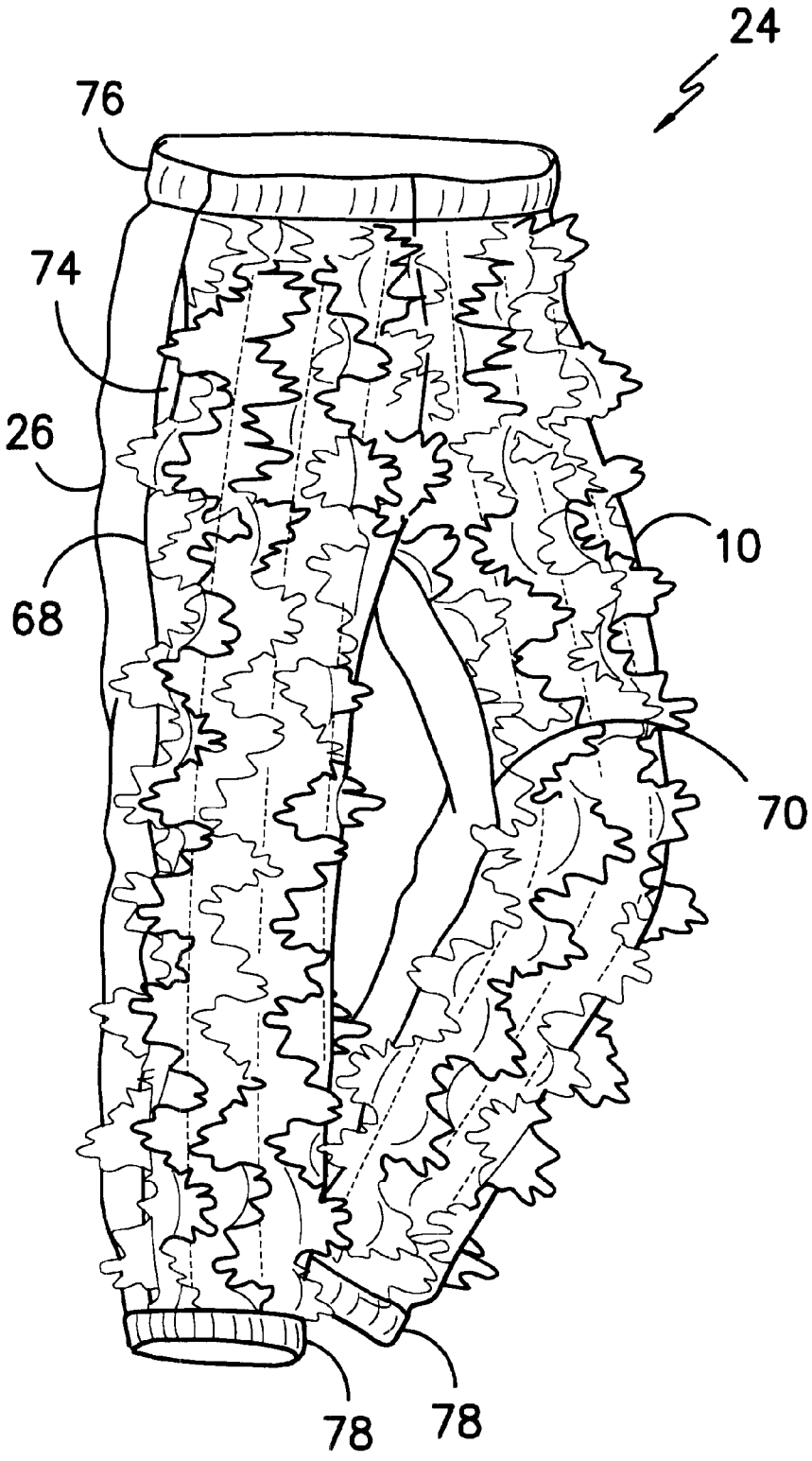
FIG. 4 provides an oblique frontal view of multidimensional, camouflage trousers.

FIG. 4 illustrates basic details of one embodiment of the camouflage trousers 24. As illustrated, the front lower groin area, front left leg and front right leg are preferably formed from the three-dimensional fabric 10. As illustrated, the three-dimensional fabric 10 preferably extends across the front of the trousers from the out-seam 68 of each leg to the in-seam 70 of the same leg. The rear portion of the trousers 24 is preferably made from the two-dimensional material 26 as previously described although portions of three-dimensional fabric 10 may be used in this area if desired. For convenience, slit openings 74 are positioned on either side of the hips for access to pockets of underlying clothing on each side. An elastic waistband 76 serves to hold the trousers 24 in a comfortable position. It is contemplated that belt loops may also be positioned around the waist and a belt used to replace or augment the waistband 76 if desired. Elastic cuffs 78 may be used to hold each leg securely in contact with the boot or shoe of the wearer. Alternatively, cuffs could be held by drawstrings or tapered and closed with attachment mechanisms such as zippers, snaps hook and loop fasteners or the like.

The recognition of the ability to selectively utilize two-dimensional fabric across large areas of the suit 20 according to the principles of this invention provides the further benefit of substantially reducing the overall mass of the suit 20. By way of example only, and not limitation, prior available outer wear camouflage suits have generally been characterized by a total mass of about 24 ounces or greater. Conversely, an adult size suit 20 utilizing selective placement of 2-D and 3-D fabric according to the present invention as described above, may be formed having a total mass of substantially less than 24 ounces. More preferably such a suit 20 may be formed having a total mass of about 18 ounces or less. Most preferably such a suit 20 may be formed having a total mass of about 16 ounces or less.

According to one exemplary practice, a large size suit 20 as illustrated and described in relation to FIGS. 3A, 3B and 4 with 2-D and 3-D fabric as described above located at the locations illustrated may be formed having a total mass of about 17 ounces with approximately half of such weight being in the trousers and the other half being in the combined jacket and hood. Such a large size suit is of a size adequate to cover the exterior of a fully clothed adult male with physical dimensions within the $95^{th}$ percentile of the population having a height of 74 inches and a weight of 223 pounds. Of course smaller size suits such as may be suitable for coverage of fully clothed adult males within about the $50^{th}$ percentile of the population having a height of about 70 inches and a weight of about 170 pounds may also be formed. It has been found that such average size suits may be formed having a total mass of not greater than about 16 ounces. Of course, still smaller size suits of even lower total mass may also be formed if desired.

While the invention has been illustrated and described in relation to certain potentially preferred embodiments, constructions and procedures, it is to be understood that such embodiments, constructions and procedures are illustrative only and that the present invention is in no event to be limited thereto. To the contrary, it is contemplated that modifications and variations embodying the principles of this invention will no doubt occur to those of skill in the art and it is thus intended that the present invention shall extend to all such modifications and variations as may incorporate the broad principles of the invention within the full spirit and scope thereof.

That which is claimed is:

1. A multi-dimensional camouflage outer wear garment system comprising:

a jacket portion for covering the torso and arms of a wearer wherein the jacket portion comprises two-dimensional camouflage material arranged in patterned combination with three-dimensional camouflage material to form an outer visible jacket surface, said three-dimensional camouflage material being disposed across a forward shoulder covering region of the jacket portion and across exterior sleeve regions of the jacket portion covering the outer arms of the wearer such that said three-dimensional camouflage material disrupts the silhouette of the wearer, and wherein said two-dimensional camouflage material is disposed across a back covering region of the jacket portion such that at least a portion of said back covering region is of substantially flat two-dimensional character.

2. The invention as recited in claim 1, wherein said three-dimensional camouflage material comprises a two layer fabric construction comprising a net substrate adjoined to a covering layer of camouflage textile material at locations of attachment wherein said covering layer is cut to form a plurality of substantially irregular lobes extending away from said net substrate and wherein said two layer fabric construction has a mass per unit area of about 3 to about 7 ounces per square yard.

3. The invention as recited in claim 2, wherein said covering layer of camouflage textile material has a mass per unit area of about 2 to about 3 ounces per square yard.

4. The invention as recited in claim 3, wherein said net substrate has a mass per unit area of about 2 to about 3 ounces per square yard.

5. The invention as recited in claim 1, wherein said three-dimensional camouflage material comprises a two layer fabric construction comprising a net substrate adjoined to a covering layer of camouflage textile material at locations of attachment wherein said covering layer is cut to form a plurality of substantially irregular lobes extending away from said net substrate and wherein said two-dimensional camouflage material is substantially identical in construction to the camouflage textile material which forms said covering layer of camouflage material.

6. The invention as recited in claim 5, wherein said covering layer of camouflage textile material has a mass per unit area of about 2 to about 3 ounces per square yard.

7. The invention as recited in claim 6, wherein said net substrate has a mass per unit area of about 2 to about 3 ounces per square yard.

8. The invention as recited in claim 1, wherein said two-dimensional camouflage material is disposed across an upper chest covering region of the jacket portion below said forward shoulder covering region of the jacket portion such that at least a portion of said upper chest covering region is of substantially flat two-dimensional character.

9. The invention as recited in claim 8, wherein said three-dimensional camouflage material is disposed across a lower abdominal covering region of the jacket portion such that at least a portion of said lower abdominal covering region is of substantially three-dimensional character.

10. The invention as recited in claim 9, wherein at least one slit opening is disposed between said upper chest covering region and said lower abdominal covering region to permit access by the wearer to clothing underlying said jacket portion.

11. The invention as recited in claim 10, wherein said at least one slit opening is covered by a displaceable flap.

12. The invention as recited in claim 8, wherein said two-dimensional camouflage material is disposed across inner sleeve regions of the jacket portion covering the inner arms of the wearer such that at least a portion of said inner sleeve regions is of substantially flat two-dimensional character.

13. The invention as recited in claim 12, wherein said two-dimensional camouflage material is disposed across substantially the entire upper chest covering region of the jacket portion below said forward shoulder covering region and across substantially the entire back covering region of the jacket portion such that said upper chest covering region below said forward facing shoulder covering region and said back covering region are substantially entirely of flat two-dimensional character.

14. A multi-dimensional camouflage outer wear garment system comprising:

a jacket portion for covering the torso and arms of a wearer wherein the jacket portion comprises two-dimensional camouflage material arranged in patterned combination with three-dimensional camouflage material to form an outer visible jacket surface, said three-dimensional camouflage material being disposed across a forward shoulder covering region of the jacket portion and across exterior sleeve regions of the jacket portion covering the outer arms of the wearer such that said three-dimensional camouflage material disrupts the silhouette of the wearer, and wherein said two-dimensional camouflage material is disposed across a back covering region of the jacket portion such that at least a portion of said back covering region is of substantially flat two-dimensional character; and a hood portion for disposition in covering relation to the head of the wearer, wherein the hood portion comprises a head covering region of three-dimensional camouflage material, a face opening within the head covering region and a face covering panel extending normally across at least a portion of the face opening, the face covering panel being operatively attached to at least one side of the face opening by an extensible attachment element such that the face covering panel may be pulled away from said at least one side of the face opening to a position below the chin of the wearer.

15. The invention as recited in claim 14 wherein said three-dimensional camouflage material comprises a two layer fabric construction comprising a net substrate adjoined to a covering layer of camouflage textile material at locations of attachment wherein said covering layer is cut to form a plurality of substantially irregular lobes extending away from said net substrate and wherein said two layer fabric construction has a mass per unit area of about 3 to about 7 ounces per square yard.

16. The invention as recited in claim 15, wherein said covering layer of camouflage textile material has a mass per unit area of about 2 to about 3 ounces per square yard.

17. The invention as recited in claim 16, wherein said net substrate has a mass per unit area of about 2 to about 3 ounces per square yard.

18. The invention as recited in claim 14, wherein said three-dimensional camouflage material comprises a two layer fabric construction comprising a net substrate adjoined to a covering layer of camouflage textile material at locations of attachment wherein said covering layer is cut to form a plurality of substantially irregular lobes extending away from said net substrate and wherein said two-dimensional camouflage material is substantially identical in construction to the camouflage textile material which forms said covering layer of camouflage material.

19. The invention as recited in claim 14, wherein said two-dimensional camouflage material is disposed across an upper chest covering region of the jacket portion below said forward shoulder covering region of the jacket portion such that at least a portion of said upper chest covering region is of substantially flat two-dimensional character.

20. The invention as recited in claim 19, wherein said three-dimensional camouflage material is disposed across a lower abdominal covering region of the jacket portion such that at least a portion of said lower abdominal covering region is of substantially three-dimensional character.

21. The invention as recited in claim 20, wherein at least one slit opening is disposed between said upper chest covering region and said lower abdominal covering region to permit access by the wearer to clothing underlying said jacket portion.

22. The invention as recited in claim 19, wherein said two-dimensional camouflage material is disposed across inner sleeve regions of the jacket portion covering the inner arms of the wearer such that at least a portion of said inner sleeve regions is of substantially flat two-dimensional character.

23. The invention as recited in claim 22, wherein said two-dimensional camouflage material is disposed across substantially the entire upper chest covering region of the jacket portion below said forward shoulder covering region and across substantially the entire back covering region of the jacket portion such that said upper chest covering region below said forward shoulder covering region and said back covering region are substantially entirely of flat two-dimensional character.

24. A multi-dimensional camouflage outer wear garment system comprising:

a jacket portion for covering the torso and arms of a wearer wherein the jacket portion comprises two-dimensional camouflage material arranged in patterned combination with three-dimensional camouflage material to form an outer visible jacket surface, said three-dimensional camouflage material being disposed across a forward shoulder covering region of the jacket portion and across exterior sleeve regions of the jacket portion covering the outer arms of the wearer such that said three-dimensional camouflage material disrupts the silhouette of the wearer, and wherein said two-dimensional camouflage material is disposed across a back covering region of the jacket portion such that at least a portion of said back covering region is of substantially flat two-dimensional character; and a trouser portion for covering the legs of a wearer wherein said trouser portion comprises two-dimensional camouflage material arranged in patterned combination with three-dimensional camouflage material to form an outer visible trouser surface, said three-dimensional camouflage material being disposed across a region of the trouser portion covering the front of the legs of the wearer and said two-dimensional camouflage material being disposed across a region of the trouser portion covering the rear of the legs of the wearer.

25. The invention as recited in claim 24, further comprising a hood portion for disposition in covering relation to the head of the wearer, wherein the hood portion comprises a head covering region of three-dimensional camouflage material, a face opening within the head covering region and a face covering panel extending normally across at least a portion of the face opening, the face covering panel being operatively attached to at least one side of the face opening by an extensible attachment element such that the face covering panel may be pulled away from said at least one side of the face opening to a position below the chin of the wearer.

26. The invention as recited in claim 24, wherein said three-dimensional camouflage material within each of said jacket portion and said trouser portion comprises a two layer fabric construction comprising a net substrate adjoined to a covering layer of camouflage textile material at locations of attachment wherein said covering layer is cut to form a plurality of substantially irregular lobes extending away from said net substrate and wherein said two-dimensional camouflage material within each of said jacket portion and said trouser portion is substantially identical in construction to the camouflage textile material which forms said covering layer of camouflage textile material.

27. The invention as recited in claim 24, wherein said two-dimensional camouflage material is disposed across an upper chest covering region of the jacket portion below said forward shoulder covering region of the jacket portion such that at least a portion of said upper chest covering region is of substantially flat two-dimensional character.

28. The invention as recited in claim 27, wherein said three-dimensional camouflage material is disposed across a lower abdominal covering region of the jacket portion such that at least a portion of said lower abdominal covering region is of substantially three-dimensional character.

29. The invention as recited in claim 27, wherein said two-dimensional camouflage material is disposed across inner sleeve regions of the jacket portion covering the inner arms of the wearer such that at least a portion of said inner sleeve regions is of substantially flat two-dimensional character.

30. The invention as recited in claim 29, wherein said two-dimensional camouflage material is disposed across substantially the entire upper chest covering region of the jacket portion below said forward shoulder covering region and across substantially the entire back covering region of the jacket portion such that said upper chest covering region below said forward shoulder covering region and said back covering region are substantially entirely of flat two-dimensional character.

31. A multi-dimensional camouflage outer wear suit comprising:

a jacket portion for covering the torso and arms of a wearer wherein the jacket portion comprises two-dimensional camouflage material having a weight in the range of about 2–3 ounces per square yard arranged in patterned combination with three-dimensional camouflage material having a weight in the range of about 4–6 ounces per square yard to form an outer visible jacket surface, said three-dimensional camouflage material being disposed across a forward shoulder covering region of the jacket portion and across exterior sleeve regions of the jacket portion covering the outer arms of the wearer and across a lower abdominal covering region of the jacket portion, and wherein said two-dimensional camouflage material is disposed across at least a back covering region of the jacket portion such that said back covering region is of substantially flat two-dimensional character;

a trouser portion for covering the legs of a wearer wherein said trouser portion comprises said two-dimensional camouflage material arranged in patterned combination with said three-dimensional camouflage material to form an outer visible trouser surface, said three-dimensional camouflage material being disposed across a region of the trouser portion covering the front of the legs of the wearer and said two-dimensional camouflage material being disposed across a region of the trouser portion covering the rear of the legs of the wearer; and a hood portion for disposition in covering relation to the head of the wearer, wherein the hood portion comprises a head covering region of said three-dimensional camouflage material;

wherein said suit is of a size at least sufficient to cover the exterior of a $50^{th}$ percentile male user and wherein the combined weight of said jacket portion, said trouser portion and said hood portion is less than about 20 ounces.

32. The invention as recited in claim 31, wherein the combined weight of said jacket portion, said trouser portion and said hood portion is less than about 18 ounces.

33. The invention as recited in claim 31, wherein the combined weight of said jacket portion, said trouser portion and s aid hood portion is in the range of about 16 ounces.

* * * * *